US006658130B2

(12) United States Patent
Huang

(10) Patent No.: US 6,658,130 B2
(45) Date of Patent: Dec. 2, 2003

(54) RECEPTACLE FOR EARPHONE CORD

(76) Inventor: Fang Tien Huang, P.O. Box 82-144, Taipei (TW)

( * ) Notice: Subject to any disclaimer, the term of this patent is extended or adjusted under 35 U.S.C. 154(b) by 217 days.

(21) Appl. No.: 09/973,059

(22) Filed: Oct. 10, 2001

(65) Prior Publication Data

US 2003/0068061 A1 Apr. 10, 2003

(51) Int. Cl.[7] ..... H04R 25/00
(52) U.S. Cl. ..... 381/384; 381/370; 379/430
(58) Field of Search ..... 381/376, 371, 381/374, 380, 384, 370; 242/400.1, 405.2, 407, 385.4; 379/430; 455/90.3; 439/501, 4, 27

(56) References Cited

U.S. PATENT DOCUMENTS 5,684,883 A * 11/1997 Chen ..... 381/385
6,371,398 B1 * 4/2002 Liao ..... 242/378.1
6,434,249 B1 * 8/2002 Wei ..... 381/370

* cited by examiner

*Primary Examiner*—Curtis Kuntz
*Assistant Examiner*—Tuăn D Nguyěñ
(74) *Attorney, Agent, or Firm*—Leong C. Lei

(57) ABSTRACT

A receptacle for earphone cord is disclosed. The present receptacle comprises a front shell and a rear shell, a retractable earphone cord mounted within the two shells, and a retracting device having a rolling disc mounted onto a pivotal seat and a retracting spring being mounted at one side of the rolling disc, one end of the spring being mounted at the rolling disc and the other end of the spring being located at a pivotal rod of the pivot seat, characterized in that a recess is provided on the rolling disc and contains soft coiled cord which is coiled into a plurality of coils, one end of the cord is connected to the earphone cord and the other end is connected to a connection wire, thereby the compactness of the soft coiled cord provides extension capability and retraction capability.

5 Claims, 6 Drawing Sheets

RECEPTACLE FOR EARPHONE CORD

BACKGROUND OF THE INVENTION (a) Technical Field of the Invention

The present invention relates to a receptacle for earphone cord, and in particular, a receptacle which is used to contain earphone cord, enhancing longevity of the earphone cord.

(b) Description of the Prior Art

FIG. 1 shows a conventional receptacle for earphone cord comprising a front shell 1 and a rear shell 2, a retractable earphone cord 40 and a retracting device 3. A retractable spring 32 located within the retractable device 3 causes a driving disc 31 to rotate and the earphone cord 40 is rolled and collected within the receptacle. However, the contact between a contacting disc 330 and a conductive disc 304 within the receptacle causes wears and thus the longevity of the conventional receptacle is reduced. Accordingly, it is an object of the present invention to provide a receptacle for earphone cord which mitigates the above drawback, and the longevity of the receptacle is increased.

SUMMARY OF THE INVENTION

Accordingly, it is an object of the present invention to provide a receptacle for earphone cord having a front shell and a rear shell, a retractable earphone cord mounted within the two shells, and a retracting device having a rolling disc mounted onto a pivotal seat and a retracting spring being mounted at one side of the rolling disc, one end of the spring being mounted at the rolling disc and the other end of the spring being located at a pivotal rod of the pivot seat, characterized in that a recess is provided on the rolling disc and contains a soft coiled cord which is coiled into a plurality of coils, one end of the cord is connected to the earphone cord and the other end is connected to a connection wire, thereby the compactness of the soft coiled cord provides extension capability and retraction capability.

Yet another object of the present invention is to provide a receptacle for earphone cord, wherein a cavity is provided to the front shell to mount the retracting device, and a top hole and a bottom hole are provided respectively on the top and bottom end of the front shell, a clipping body is provided on the rear shell and a top hole and a bottom hole are respectively provided on the top and bottom end of the inner side of the rear shell such that a through hole is formed by the combination of the top and bottom holes of the rear and front shells for the passage of the connection cord or the earphone cord.

A further object of the present invention is to provide a receptacle for earphone cord, wherein the retracting device includes a pivot seat, a rolling disc, a retracting spring and a soft coiled cord, and the pivot seat is located on the front shell and a pivot rod is located on the pivot seat for the pivotal mounting of the rolling disc, one side of the pivot seat is an actuating disc having one end being extended to a push button and the other end is mounted at an engaging recess of the rolling disc, and a pulling spring is mounted to the actuating disc.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
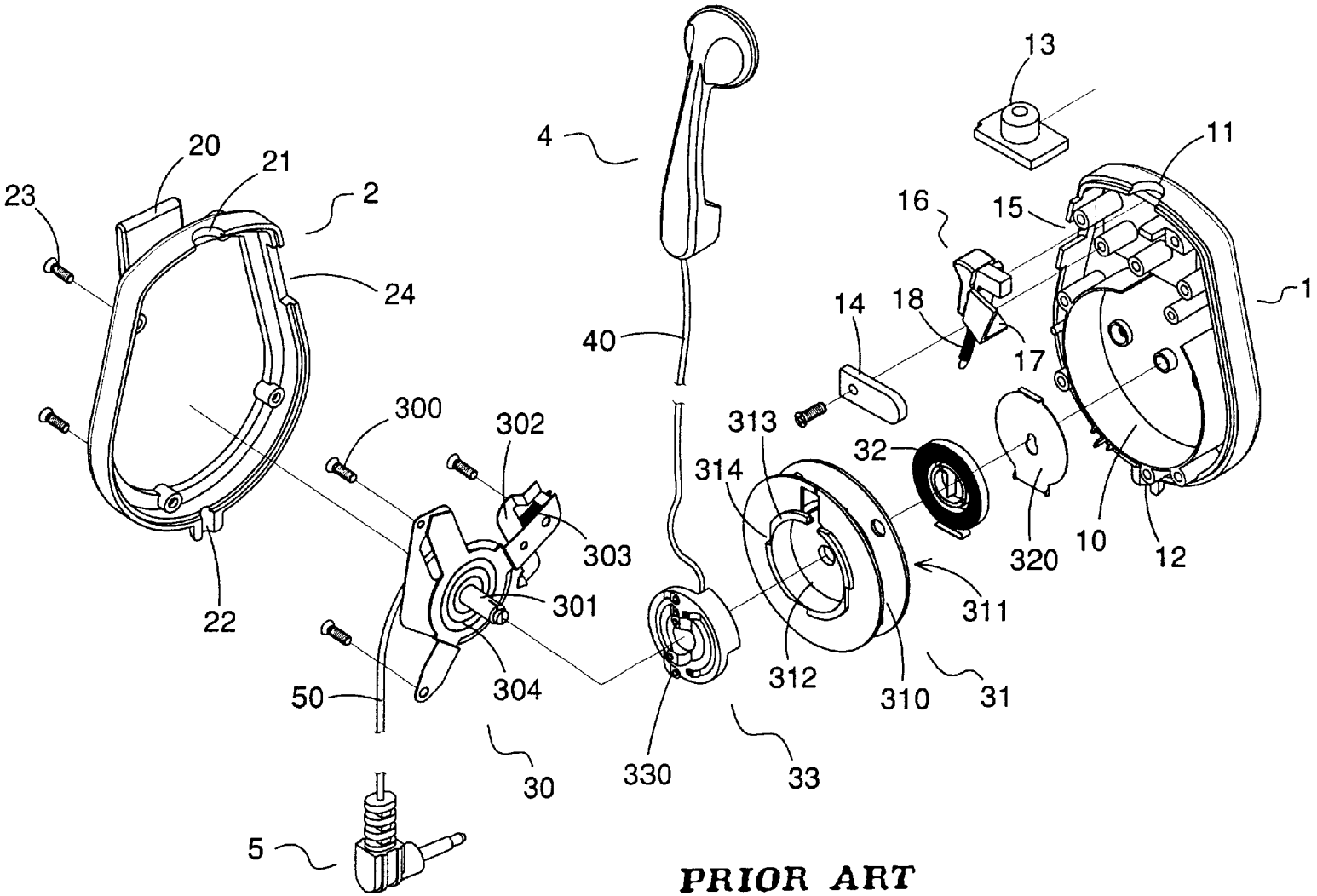
PRIOR ART FIG. 1
FIG. 1 is a perspective exploded view of a conventional earphone cord receptacle box.
Figure 2:
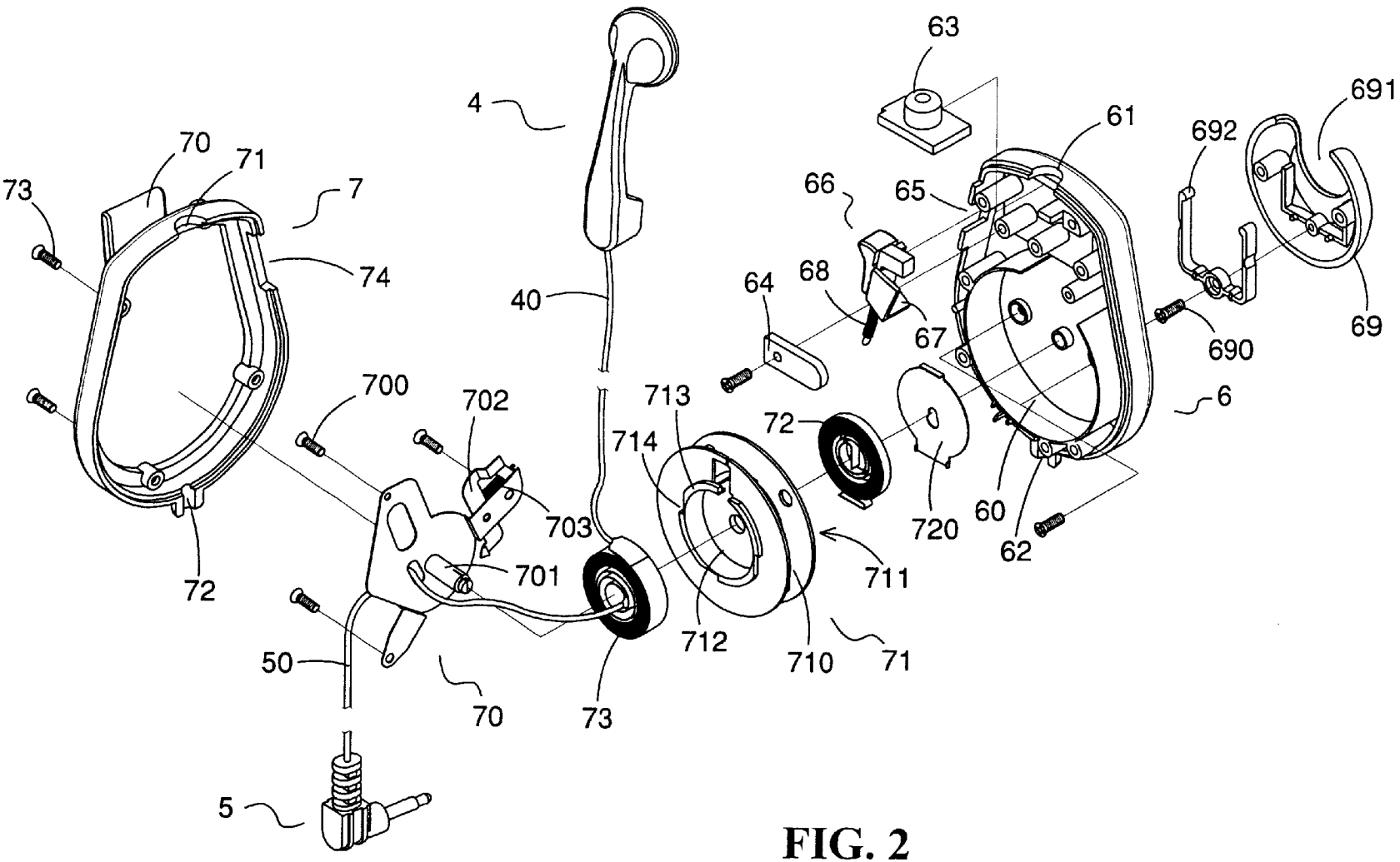
FIG. 2 is an exploded perspective view of a receptacle for earphone cord of the present invention.
Figure 3:
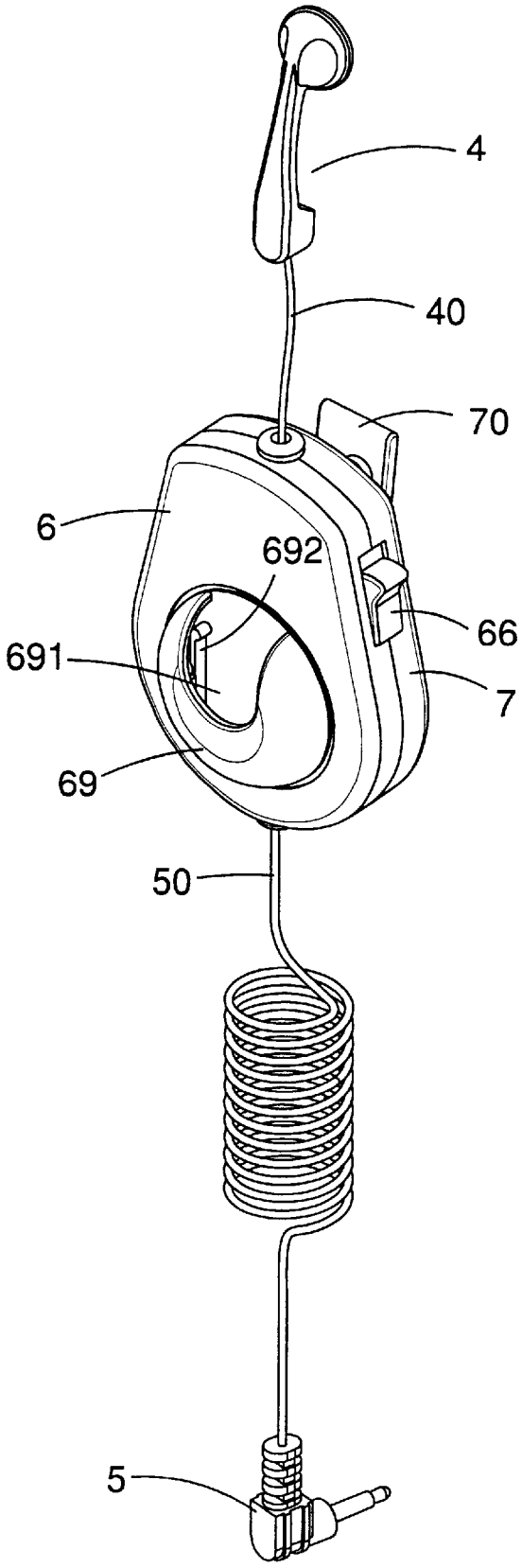
FIG. 3 is a perspective view of a receptacle for earphone cord of the present invention.

Referring to FIGS. 2 to 5, there is shown a receptacle for earphone cord having a front shell 6, a rear shell 7, a retractable ear-phone cord 40 located between the rear and the front shell 7, 6, and a retracting device 8 for connection with an external connection cord 50.

The front shell 6 having a top hole 61, and a bottom hole 62 has a cavity 60 for holding the retracting device 8. The top hole 61 has a leading mount 63 and a press block 64 to restrict the earphone cord 40. One side of the front shell 6 has a notch 65 for the mounting of a push button 66 to slide thereon. One side of the button 66 has a sloping face 67 to control the retracting device 8. The other side of the button 66 has a pulling spring 68 having one end mounted to the front shell 6. The outer side of the front shell 6 is mounted with a cap 69 with screw 690 and there is a notch 691 on the cap 69 for the holding of an earphone 4. A hook 692 is provided within the cap 69 to hold the earphone 4.

The rear shell 7 is mounted to the front shell 6 with screw 73, and has a clipping body 70 for clipping the receptacle onto a belt of a user. There is a top hole 71 and a bottom hole 72 located respectively at the top and bottom end of the rear shell 7, and these holes 71, 72 are in alignment with the top hole 61 and the bottom hole 62 of the front shell 6 to form a through hole for the passage of the earphone cord 40 and the connection cord 50. A notch 74 is located at the side of the rear shell 7 and is combined with the notch 65 of the front shell 6 to form a mounting for the push button 66.

The retracting device 8 includes a pivot seat 80, a rolling disc 81, a retracting spring 82 and a soft coiled cord 83. The pivot seat 80 is mounted to the front shell 6 by screw 800 and has a pivot rod 801 for the pivotal mounting of the rolling disc 81. One side of the pivot seat 80 has an actuating disc 802 having one end extended to the push button 66. The other end of the actuating disc 802 is extended to an engaging slot 814 of the protruded edge 813 at one side of the rolling disc 81, and the actuating disc 802 has a pulling spring 803. The other end of the pulling spring 803 is mounted onto the pivot seat 80, and the surrounding edge of the rolling disc 81 has a rolling slot 810 allowing the earphone cord 40 to be surrounded thereto. One side of the rolling disc 81 has a spring slot 811 to hold the retracting spring 82. The other side of the rolling disc 81 has a recess 812 to accommodate the soft-coiled cord 83. A protruded edge 813 is provided at the slot edge of the recess 812, and there are a plurality of engaging slots 814 located on the protruded edge 813 for the mounting of one end of the actuating disc 802. One end of the spring 82 is mounted to the rolling disc 81 and one end of the inner side of the spring 82 has a pivot rod 801. The outer side of the spring 82 has a spring cap 820 to be mounted onto the spring slot 811. The soft-coiled cord 83 is rolled into coils and is located in the recess 812, and one end of the cord 83 is connected to the earphone cord 40, and the other end is connected to the connection wire 50.

The earphone cord 40 is a cord extended from the earphone 4 having one end being connected to one end of the coiled cord 83.

The connection wire 50 is a wire extended from a connector 5, and the connector can be mounted with the output of a mobile phone or earphone to transmit signals from the output device to the earphone 4. One end of the connection wire 50 is connected to the soft-coiled cord 83.

Figure 6:
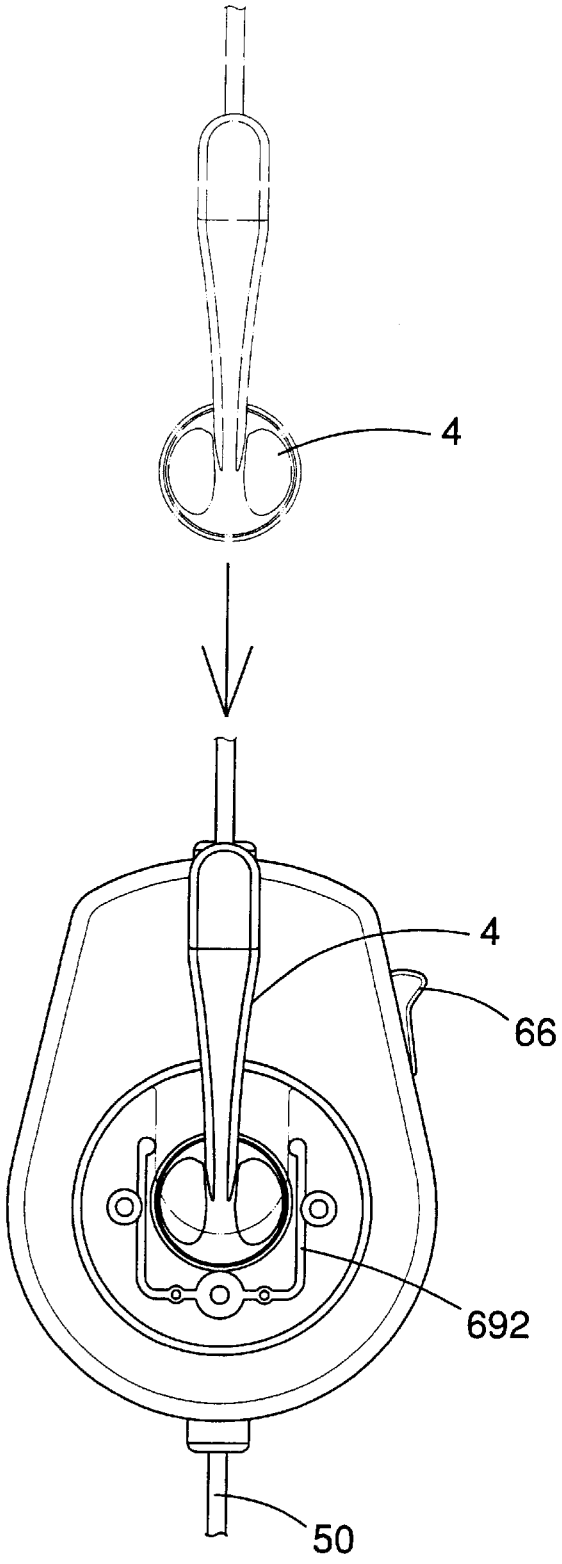
FIG. 6 is a schematic view showing the retraction and extension of a receptacle for earphone cord of the present invention.

As shown in FIG. 6, when the earphone 4 is pressed, the hook 692 is extended and the hook 692 secures the earphone 4. The earphone 4 is restricted within the cap 69. When the earphone 4 is pulled out, the hook 692 is extended outward in the pulling direction and the earphone 4 is dislocated from the cap 69.

Figure 5:
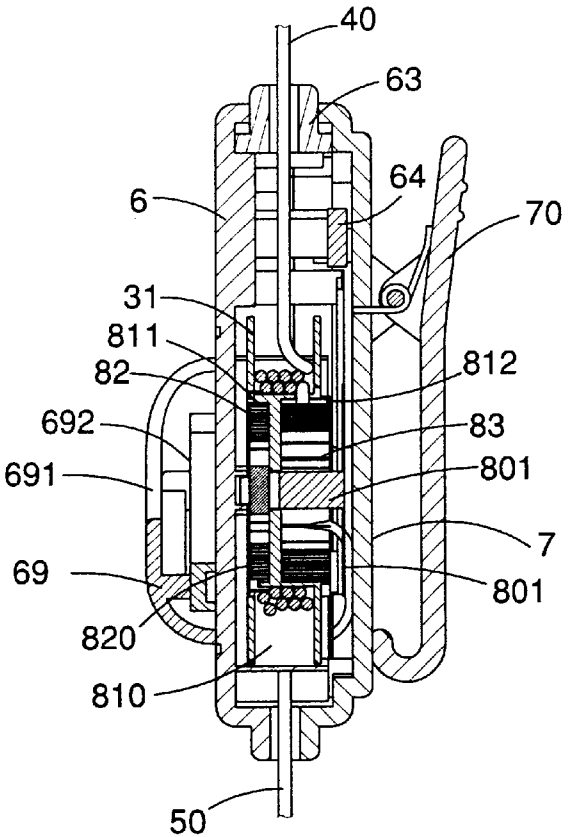
FIG. 5 is a sectional view along line A—A of FIG. 4.
Figure 4:
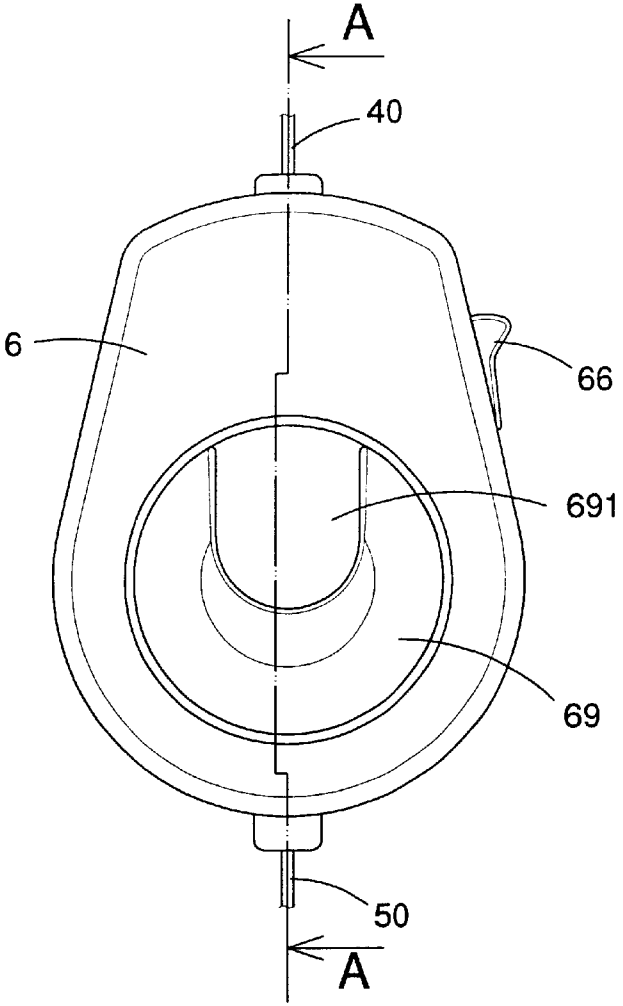
FIG. 4 is a front view of a receptacle for earphone cord of the present invention.
Figure 7:
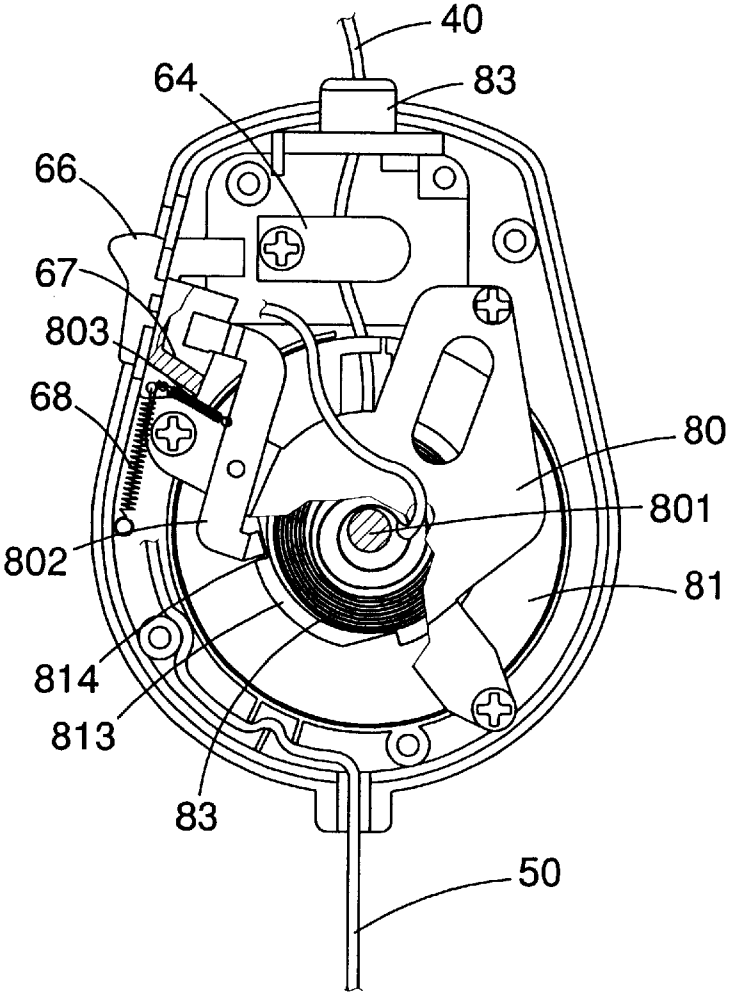
FIG. 7 is a schematic view showing the components of a receptacle for earphone cord of the present invention.
Figure 8:
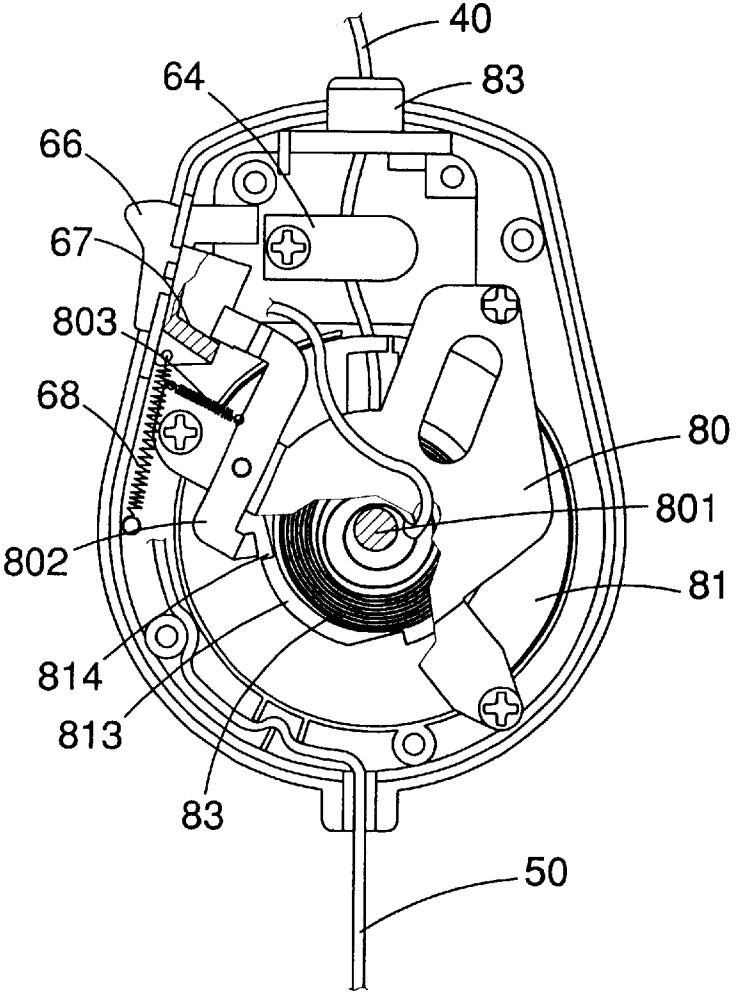
FIG. 8 is a schematic view showing the retraction of a receptacle for earphone cord of the present invention.

As shown in FIGS. 5, 7 and 8, when the earphone cord 40 is pulled out, the rolling disc 31 will rotate and the spring 82 becomes taut and the coiled cord 83 will surround the pivot rod 801 as the rolling disc 81 is driven to rotates. When the earphone cord 40 is released, the actuating disc 802 will engage the cord 40 and when the push button 66 is pushed upward, the sloping face 67 will contact will the lower end of the actuating disc 302 and the earphone cord 40 will be rapidly rolled to the rolling disc 81 and the coiled cord 83 will be released. When the push button 66 is released, the pulling force of the spring 68 will cause the push button 66 to move to the original position. At the same time, the actuating disc 802 will be engaged at the engaging slot 814 of the protruded edge 813 at the top end thereof so that the rolling disc 81 is restricted to rotate.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A receptacle for earphone cord having a front shell and a rear shell, a retractable earphone cord mounted within the two shells, and a retracting device having a rolling disc mounted onto a pivotal seat and a retracting spring being mounted at one side of the rolling disc, one end of the spring being mounted at the rolling disc and the other end of the spring being located at a pivotal rod of the pivot seat, characterized in that a recess is provided on the rolling disc and contains soft coiled cord which is coiled into a plurality of coils, one end of the cord is connected to the earphone cord and the other end is connected to a connection wire, thereby the compactness of the soft coiled cord provides extension capability and retraction capability.

2. The receptacle for earphone cord of claim 1, wherein a cavity is provided to the front shell to mount the retracting device, and a top hole and a bottom hole are provided respectively on the top and bottom end of the front shell, a clipping body is provided on the rear shell and a top hole and a bottom hole are respectively provided on the top and bottom end of the inner side of the rear shell such that a through hole is formed by the top and bottom holes of the rear and front shells for the passage of the connection cord or earphone cord.

3. The receptacle for earphone cord of claim 1, wherein the retracting device includes a pivot seat, a rolling disc, a retracting spring and a soft coiled cord, and the pivot seat is located on the front shell and a pivot rod is located on the pivot seat for the pivotal mounting of the rolling disc, one side of the pivot seat is an actuating disc having one end being extended to a push button and the other end being mounted at an engaging recess of the rolling disc, a pulling spring is mounted to the actuating disc.

4. The receptacle for earphone cord of claim 3, wherein one side of the push button has a sloping surface allowing the pushing of the bottom end of the actuating disc.

5. The receptacle for earphone cord of claim 1, wherein a cap is provided to the external side of the front shell and has a notch to accommodate an earphone, and a hook is provided within the cap to secure the earphone.

* * * * *